US005807216A

United States Patent [19]

Arad

[11] Patent Number: 5,807,216

[45] Date of Patent: Sep. 15, 1998

[54] AQUATIC EXERCISE CHAMBER

[76] Inventor: Yoel Arad, Moshava Yesod Hamaala, 12105, Israel

[21] Appl. No.: 504,222

[22] Filed: Jul. 19, 1995

[30] Foreign Application Priority Data

Jul. 19, 1994 [IL] Israel ..... 110360

[51] Int. Cl.[6] ..... A63B 26/00

[52] U.S. Cl. ..... 482/111; 482/148

[58] Field of Search ..... 482/111, 129, 482/148

[56] References Cited

U.S. PATENT DOCUMENTS

| | | | |
|---|---|---|---|
| 4,576,376 | 3/1986 | Miller . | |
| 4,712,788 | 12/1987 | Gaudreau | 272/69 |
| 4,756,376 | 7/1988 | Shimizu | 180/79 |
| 4,759,544 | 7/1988 | Diaz | 272/93 |

*Primary Examiner*—Lynne A. Reichard
*Attorney, Agent, or Firm*—Ladas & Parry

[57] ABSTRACT

A device for exercising while being at least partially submerged in water, including a rigid frame adapted to support the weight of a person using the device; and collapsible water container which is at least partially supported by the rigid frame.

14 Claims, 5 Drawing Sheets

100
102
104
106

AQUATIC EXERCISE CHAMBER

FIELD OF THE INVENTION

The present invention relates generally to exercise equipment and, specifically, to an aquatic exercise chamber.

BACKGROUND OF THE INVENTION

Exercising in water is considered among the best activities for improving the condition of the heart and lungs and for enhancing elastic and muscle operation.

Despite the physical exertion and effort involved, exercising in water does not involve impact and thus does not cause damage to joints and bones. Furthermore, aquatic exercises provide an aerobic workout.

However, the availability of facilities which are suitable for aquatic exercising is fairly limited. While public swimming pools are widespread and generally available, they are not an ideal venue for aquatic exercising due to privacy, travel and time considerations. Private swimming pools are an option, however, they are expensive to install and to maintain and require a fairly large area of dedicated space. Also, private swimming pools are not portable, nor are they collapsible for easy storage.

A Jacuzzi or outdoors hot tub, while having lesser space requirements, is generally not sufficiently deep for aquatic exercising. Moreover, as with a private pool, a Jacuzzi is neither portable nor collapsible and may be quite costly to install.

SUMMARY OF THE INVENTION

The present invention seeks to provide a free-standing, portable and collapsible, inexpensive aquatic exercise chamber device.

The device of the present invention does not require a large set-up area, nor are there special installation requirements.

The exercise chamber of the present invention is suitably deep and sufficiently wide so as to allow a user to carry out a variety of exercises including "swimming" in a standing or upright position.

There is thus provided, in accordance with a preferred embodiment of the present invention a device for exercising while being at least partially submerged in water including a rigid frame which is adapted to support the weight of a person using the device and a collapsible water container which is at least partially supported by the rigid frame.

According to one preferred embodiment of the present invention, the frame includes at least one detachable segment and can be easily assembled and disassembled providing portability and storability.

In accordance with a further embodiment of the invention, the collapsible water container is formed of a material which is collapsible yet substantially non-stretchable, such as PVC sheeting.

Furthermore, the bottom of the collapsible water container may rest on the ground at ground level.

Alternatively, the device may be located at least partially under ground thus providing the water container with protection and insulation.

Moreover, in accordance with yet a further embodiment of the present invention, exercise devices (e.g. a chin-up bar) may be included in the device and may be supported by an upper portion of the frame.

Further in accordance with the present invention, the water container is preferably generally cylindrical.

Additionally, the water container may be sufficiently deep so as to allow the person using it to be in a substantially upright position.

Preferably, the water container is at least 1.5 meters deep and has a diameter of no more than 1.5 meters.

Also, in order to achieve a jacuzzi or water massage effect, an external pump may be included in the present invention. In addition to circulating water within the water container, the pump may provide water heating and/or filtering.

Furthermore, the device may include a platform having an adjustable height enabling use of the device by children or adults having a shorter stature.

In accordance with an alternative embodiment of the present invention, the aquatic exercise chamber device may include a rigid frame adapted to support the weight of a person using the device and a water container, formed of a rigid material, which is suitably deep to allow exercising therein.

In accordance with a further alternate embodiment of the present invention, the aquatic exercise chamber includes a collapsible water container adapted to contain a level of water suitable for accommodating a user in a substantially upright position and a rigid frame connected to said water container and which is capable of supporting the weight of the user.

Furthermore, in a preferred embodiment, the aquatic exercise is adapted to contain a level of water sufficient to allow the exercise carried out by the user to include treading of water.

BRIEF DESCRIPTION OF THE DRAWINGS

The present invention will be understood and appreciated more fully from the following detailed description, taken in conjunction with the drawings in which.

DETAILED DESCRIPTION OF PREFERRED EMBODIMENTS

Figure 1:
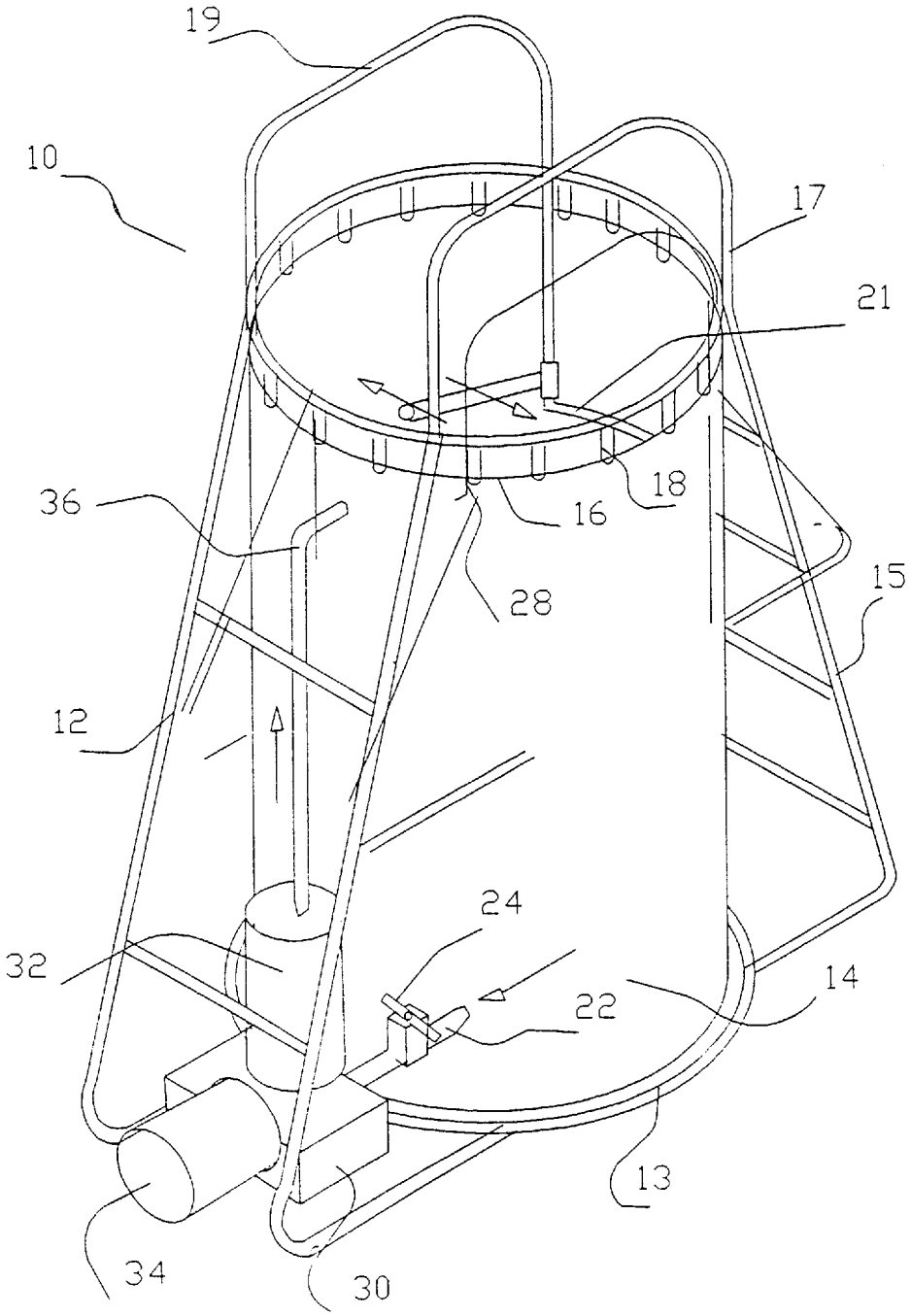
FIG. 1 is a simplified illustration of an aquatic exercise chamber apparatus constructed in accordance with a preferred embodiment of the present invention.

Reference is now made to FIG. 1 which schematically illustrates the basic functional arrangement of an aquatic exercise chamber device 10 constructed in accordance with a preferred embodiment of the present invention.

Aquatic exercise chamber device 10 comprises a frame assembly 12 and a collapsible water container 14.

Water container 14 is typically in the form of a vertical cylinder and is preferably formed of PVC sheeting reinforced by a polyester fiber net. Alternatively, water container 14 may be formed of any material which is sufficiently strong to maintain its general shape when holding water, while being sufficiently flexible so as to be collapsible when empty.

Frame assembly 12 preferably comprises a base portion 13, a steps portion 15, and an upper assembly 17.

Preferably, frame assembly 12 is formed of a lightweight, sturdy material which is suitable for the outdoors, such as painted metal tubing. Furthermore, frame assembly 12 preferably comprises several detachable segments which can be assembled and disassembled with relative ease. For example, base 13 and upper assembly 17 may be formed of metal tubes having beveled ends for insertion into metal tubing of steps portion 15.

Upper assembly 17 comprises an upper portion of frame assembly 12 and preferably includes parallel bars 19 which may be used as handlebars by a user while carrying out a variety of aquatic exercises.

Water container 14 is preferably collapsible and is preferably extendible to a maximum height of about 1.9 meters (75") providing sufficient depth for aquatic exercising. A typical diameter of water container 14 is about 1.20 meters (47").

Upper rim 16 of water container 14 is connected to upper assembly 17 by a plurality of connectors 18. Connectors 18 may comprise openable rings which connect upper assembly 17 to a series of holes 28 in upper rim 16.

While in the extended position, the sidewall of water container 14 is preferably partially supported by upper assembly 17 using connectors 18.

Alternatively, upper assembly 17 may comprise other types of connectors. For example, a rope may be threaded between holes 28 of upper rim 16 and upper assembly 17 providing at least partial support for the sidewall of water container 14.

While frame assembly 12 provides partial support for water container 14, most of the load of the container 14 and of the water therein is borne by the ground upon which water container 14 rests. Typically, frame assembly 12 includes an arrangement, such as a ladder or steps on step portion 15, for climbing up to the open top of water container 14 and for supporting the user during exercising.

As described hereinbelow with particular reference to FIGS. 2A–2C, upper frame assembly 17 may also be used as a support to which exercise accessories are attached or mounted. Alternatively or additionally, upper frame assembly 17 may be used as a support for a ladder 21 comprising handles which extend perpendicularly therefrom.

After water container 14 is extended and connected to upper frame assembly 17, water container 14 is filled with water from a hose (not shown) or any other convenient source of water.

The height of water in water container 14 is preferably user-controlled and can be adjusted in accordance with user preference, user height and exercises that are to be performed. Water container 14 preferably includes a water outlet 22 having a drain valve 24 for draining excess water from the container 14. Water outlet 22 and drain valve 24 are preferably positioned near the bottom of water container 14.

In some embodiments of the present invention, the exercise chamber includes an external pump 34, a filter 32 and a heating device 30. Pump 34 is operative to remove water from water container 14 through water outlet 22 for filtering by filter 32 and/or heating by heating device 30 of the water, and to introduce the filtered and/or heated water through a water inlet 36 to water container 14. This can be used for a water massage or Jacuzzi effect within water container 14. Filtering and/or heating of the water may be performed using any heating/filtering device as is known in the art.

Aquatic exercises may be performed by a person standing on the bottom of water container 14. Alternately, the user can "swim" or tread water in an upright position using hand and feet movement such as the "Dog Paddle". Treading water is a powerful workout for the body and is less stressful to the neck region than some swimming strokes, e.g. the breast stroke.

Moreover, pull-ups or other exercises can be performed by the user who is partially submerged in the water by grasping parallel bars 19 of frame assembly.

Exercises which are performed while a user is partially submerged in water are generally easier since the water causes decreased body weight. Additionally, while exercising in water, the user does not sweat. Furthermore, the water has a cooling effect on the body of the user thus allowing the user to carry out a longer workout.

After water container 14 is emptied of water, it may be detached from frame assembly by releasing connectors 18. Water container 14 and frame assembly 12 may then be collapsed for storage or for transfer to a new site.

In some embodiments of the present invention, upper rim 16 of water container 14 may be connected to a lower portion of frame assembly 12 via connectors (not shown) which are preformed or added to the lower portion of frame assembly 12. This embodiment is particularly suited for children or people with shorter stature so that their head will extend beyond upper assembly 17 while standing on the floor of water container 14.

This preferred embodiment preferably uses an alternate frame assembly (not shown) having a lower profile over the ground.

Figure 2C:
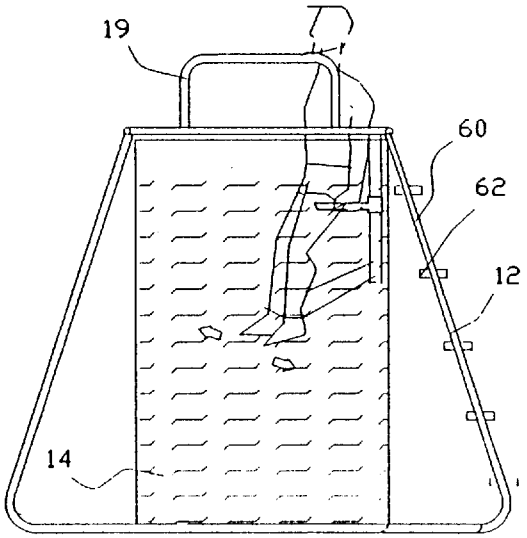
FIGS. 2A, 2B, and 2C are simplified illustrations of exercising accessories which may be used with the apparatus of FIG. 1.
Figure 2B:
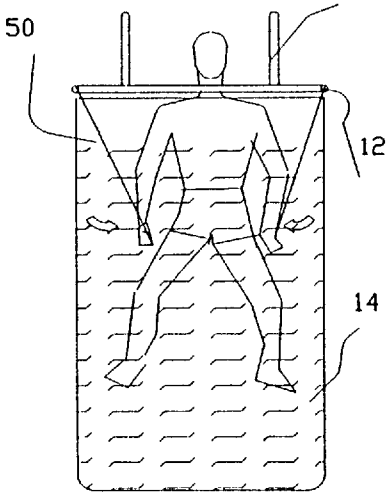
Figure 2A:
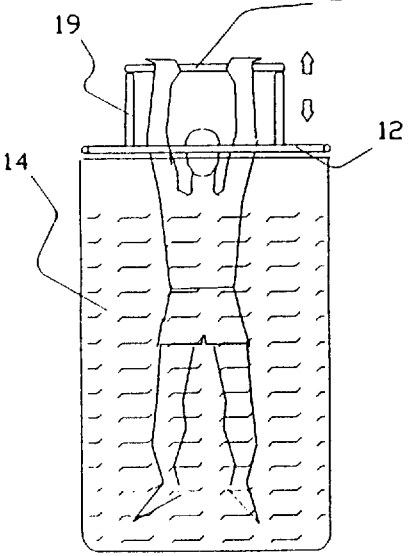

FIG. 2A describes an aquatic exercising chamber similar to that of FIG. 1 but also including a chin-up bar 42 in accordance with a further preferred embodiment of the invention.

Chin-up bar 42 is preferably mounted in between the parallel bars 19 of frame assembly 12 (FIG. 1). This accessory broadens the range of exercise possibilities to include additional exercises, e.g. chin-ups. This type of exercise is particularly improved by the present invention, since the average person will generally accomplish more chin-ups while partially submerged in water than while exercising in a dry environment.

FIG. 2B describes an aquatic exercising chamber similar to that of FIG. 1 but also including elastic stretching members 50 in accordance with another preferred embodiment of the invention.

Elastic stretching members 50, which preferably comprise rubber straps, are attached to frame assembly 12. Preferably there are two elastic stretching members 50 secured to opposing sides of frame assembly 12 to provide one stretching member 50 for each hand of the user. Elastic stretching members 50 are preferably detachable from frame assembly 12.

FIG. 2C describes an aquatic exercising chamber similar to that of FIG. 1 but also including an internal ladder 60, in accordance with another preferred embodiment of the invention. Ladder 60 is preferably suspended from upper assembly 17 and is submerged in the water of water container 14.

In some embodiments of the invention, ladder 60 further comprises swinging handles 62 extending perpendicularly from ladder 60 which may be grasped by the user to provide upper body support while partially submerged in the water in water container 14.

Figure 3:
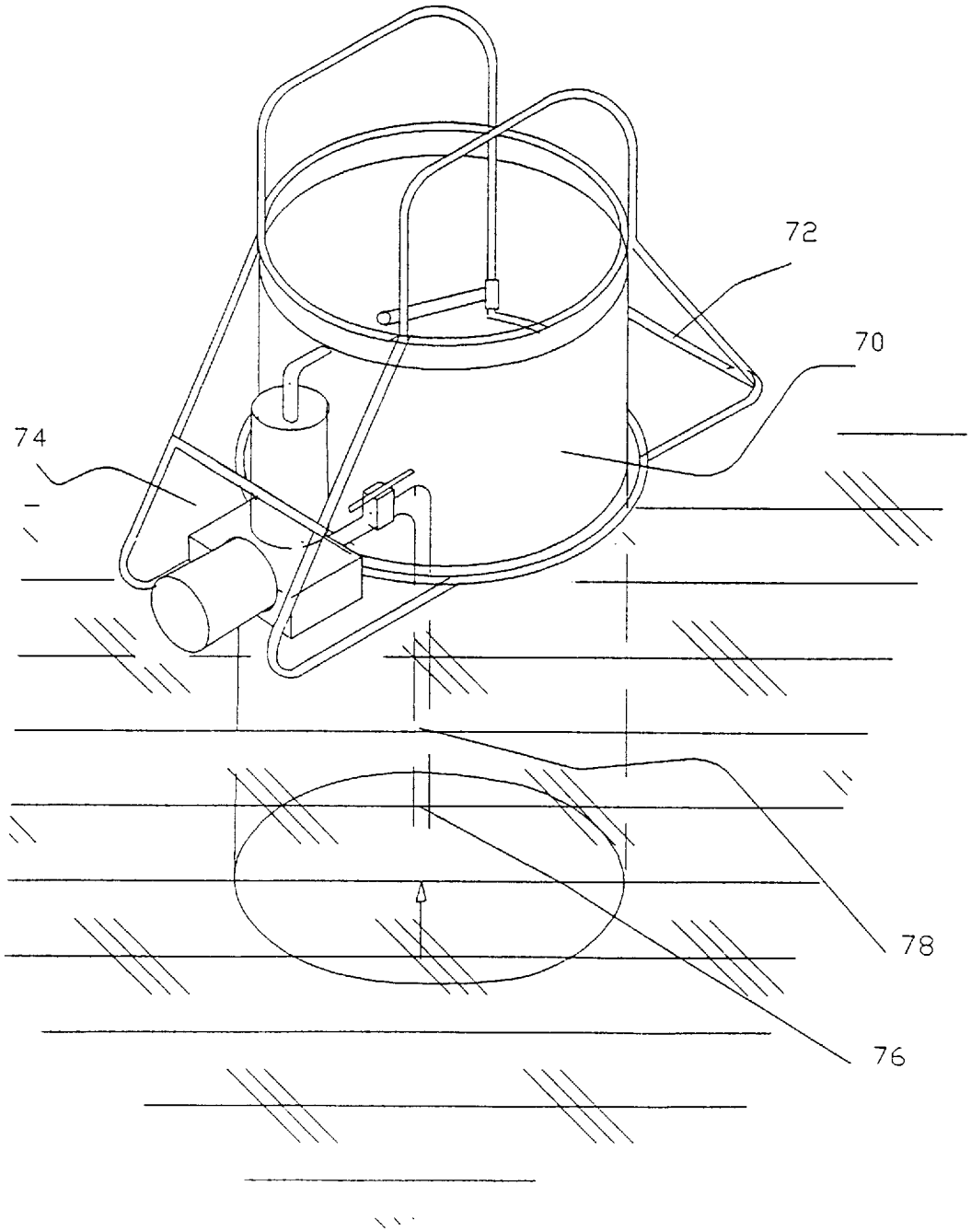
FIG. 3 is a simplified illustration of an aquatic exercise chamber, having a substantial portion thereof below ground in accordance with another preferred embodiment of the present invention.

FIG. 3 schematically illustrates a further preferred embodiment of the present invention in which a substantial portion of a water container 70 is below ground level.

In accordance with the embodiment of FIG. 3, a predetermined portion of water container 70, which may be constructed generally as described above with reference to FIG. 1, is placed in a pit or hole in the ground. The remaining portion of water container 70 extends above ground level. This embodiment may be preferred for aesthetic reasons. Moreover, the ground surrounding water container 70 insulates and protects the water in water container 70. For further insulative benefits, gaps between the sidewall of water container 70 and the walls of the hole may be filled with an insulating material (not shown) such as styrofoam. It should be noted that frame assembly 72 has a lower profile above ground level than frame assembly 12 (FIG. 1).

A pump arrangement 74 comprising a filter and/or heater such as that described hereinabove with reference to FIG. 1 is preferably used also in the embodiment of FIG. 3. In this embodiment, water is removed from water container 70 at outlet 76 for filtering and/or heating. The filtered and/or heated water is carried by pipe 78 from pump 74 up from a generally bottom region of water container 70. Additionally, pump 74 can be used to drain water from water container 70.

Figure 4:
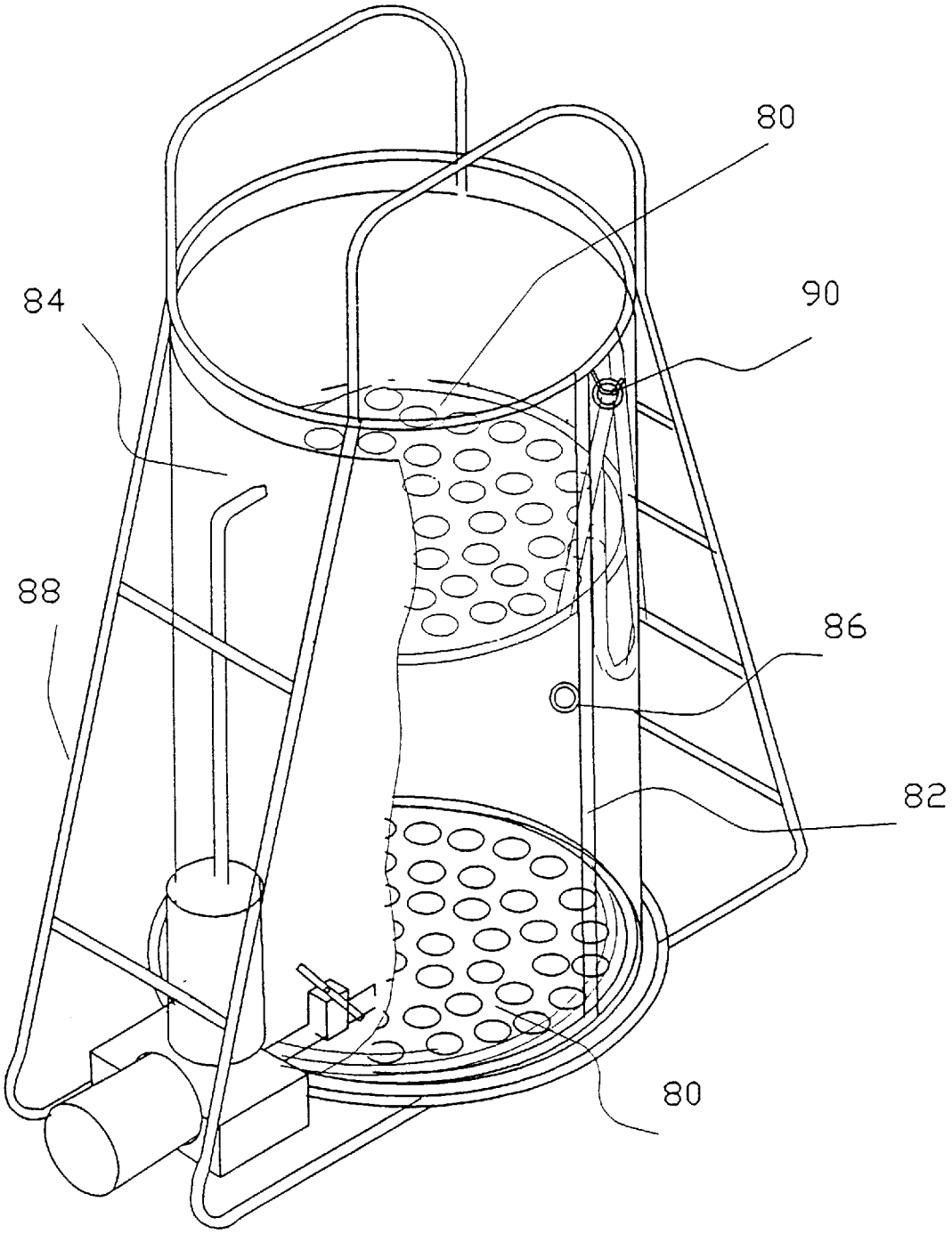
FIG. 4 is a simplified illustration of a water container suitable for aquatic exercise and having an adjustable inner platform in accordance with yet another preferred embodiment of the present invention.

FIG. 4 illustrates a further preferred embodiment of the present invention in which the aquatic exercise chamber further comprises an adjustable platform 80, the height of which can be raised or lowered.

Adjustable platform 80 is preferably comprised of a preferably circular grate which allows passage of water therethrough. At least two grate supports 82 are attached to adjustable platform 80 and preferably extend at least the entire length of water container 84 so that adjustable platform 80 rests on the bottom of container 84, when in a lowered position. It is noted that adjustable platform 80 is also shown in FIG. 4 in a raised position 80'.

Preferably each grate support 82 includes at least one connector 86 which may be of the type described hereinabove with reference to connectors 18 of FIG. 1.

The height of adjustable platform 80 can be manually controlled by pulling grate supports 82 to raise adjustable platform 80 to a desired height and then fixing connector 86 to frame assembly 88. For example, frame assembly 88 may comprise a hook shaped extension 90.

In some embodiments of the invention, an external pump arrangement 83 as described hereinabove is also used for filtering and/or heating and/or circulating of the water in water container 84.

Figure 5:
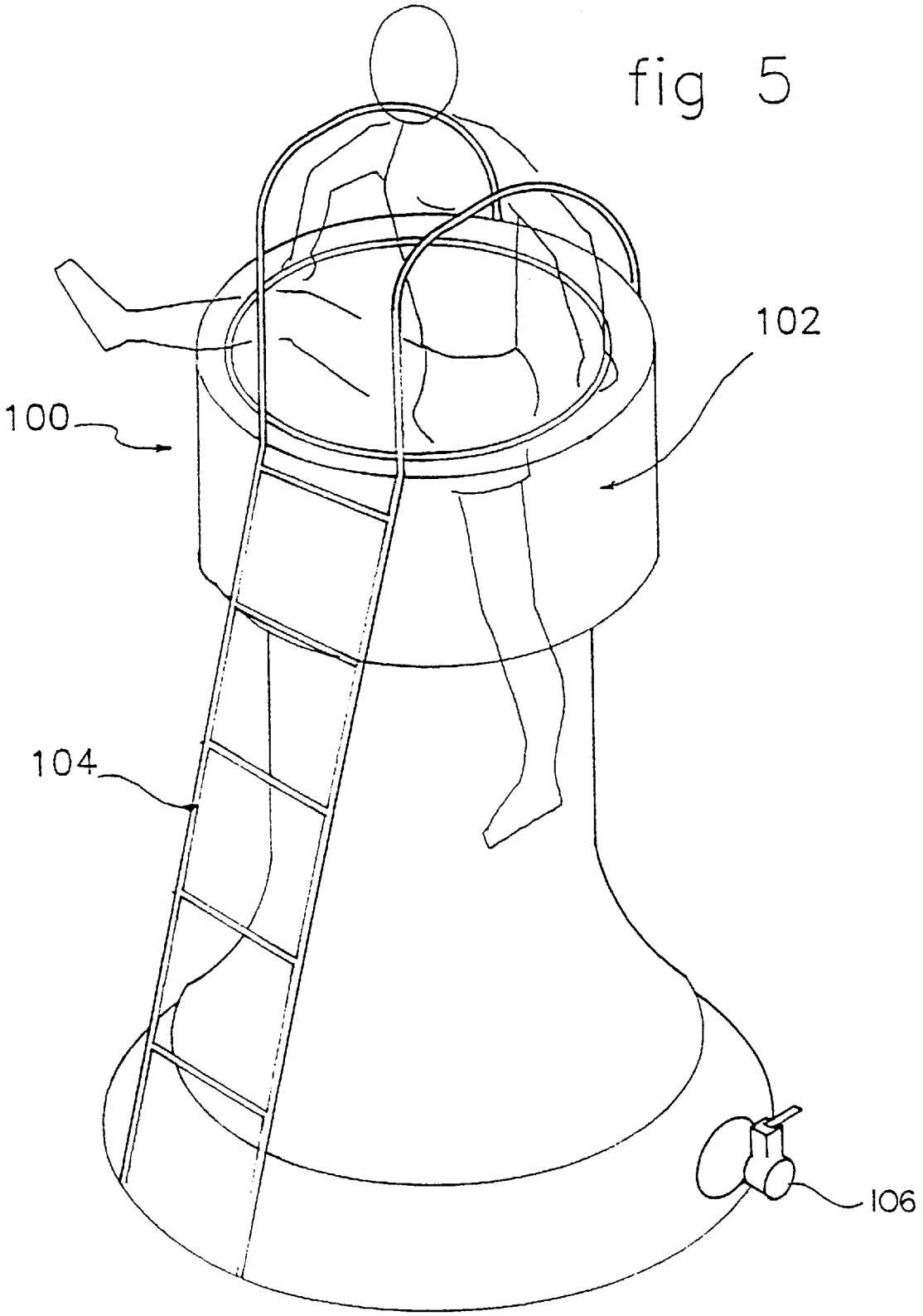
FIG. 5 is a simplified illustration of a rigid-walled water container which is suitable for aquatic exercising in accordance with a further, preferred embodiment of the present invention.

FIG. 5 is a schematic illustration of an aquatic exercise chamber 100 in accordance with a further, preferred embodiment of the present invention. In accordance with this embodiment, water container 102 preferably is formed of a rigid, preferably plastic material. Water container 102 is fixed to a frame assembly 104 and typically can not be collapsed.

Water is preferably filled into water container 102 and drained therefrom either using a pump (not shown) or a drain valve 106 as described hereinabove with reference to FIG. 1.

Water container 102 is preferably at least 1.5 meters in depth.

It will be appreciated by persons skilled in the art that the present invention is not limited to what has been thus far described. Rather, the scope of the present invention is limited only by the following claims:

I claim:

1. A device for use in exercise while a user is at least partially submerged in water, the device comprising:

a rigid frame including a bottom portion arranged to be supported on a support surface, an intermediate portion including at least one step for a user and a top portion including a peripheral water container support portion and a pair of parallel bars for use by the user in exercise; and a collapsible water container which is at least partially supported by the rigid frame and having an upper rim which is connected to said peripheral water container support portion, thereby to support said water container from above.

2. A device according to claim 1 wherein the frame comprises at least one detachable segment.

3. A device according to claim 1 and wherein the collapsible water container is formed of a collapsible yet substantially non-stretchable material.

4. A device according to claim 3 and wherein the collapsible yet substantially non-stretchable material comprises PVC sheeting.

5. A device according to claim 1 and wherein the bottom of the collapsible water container rests on the ground.

6. A device according to claim 1 and further comprising at least one exercise device supported by an upper portion of the frame.

7. A device according to claim 6 and wherein said at least one exercise device includes a chin-up bar.

8. A device according to claim 1 and wherein said water container is generally cylindrical.

9. A device according to claim 1 and wherein the water container is at least 1.5 meters deep.

10. A device according to claim 8 and wherein the diameter of the water container is no more than about 1.5 meters.

11. A device according to claim 1 and further comprising a pump which circulates water from said water container.

12. A device according to claim 1 and further comprising a height-adjustable platform placed inside of said water container.

13. A device according to claim 1 and wherein the water container is at least partially under ground level.

14. A device according to claim 1 and wherein said collapsible water container has a depth extendible to 1.9 meters.

* * * * *